United States Patent [19]

Ohgami

[11] 4,402,293

[45] Sep. 6, 1983

[54] AIR-FUEL RATIO CONTROL SYSTEM

[75] Inventor: Masaaki Ohgami, Musashino, Japan

[73] Assignees: Fuji Jukogyo Kabushiki Kaisha, Tokyo; Nissan Motor Co., Ltd., Yokohoma, both of Japan

[21] Appl. No.: 240,690

[22] Filed: Mar. 5, 1981

[30] Foreign Application Priority Data

Mar. 7, 1980 [JP] Japan ..... 55-29330

[51] Int. Cl.[3] ..... F02D 35/00

[52] U.S. Cl. ..... 123/440; 123/489

[58] Field of Search ..... 123/440, 489

[56] References Cited

U.S. PATENT DOCUMENTS

| | | | |
|---|---|---|---|
| 4,029,061 | 6/1977 | Asano | 123/489 |
| 4,108,121 | 8/1978 | Minami et al. | 123/440 |
| 4,214,558 | 7/1980 | Nishioka et al. | 123/489 |
| 4,320,730 | 3/1982 | Takada et al. | 123/489 |

*Primary Examiner*—Parshotam S. Lall

*Attorney, Agent, or Firm*—Martin A. Farber

[57] ABSTRACT

An air-fuel ratio control system for an internal combustion engine having an intake passage, an exhaust passage, an air-fuel mixture supply, on-off type electromagnetic valve for correcting the air-fuel ratio of the air-fuel mixture supplied by said air-fuel mixture supply, a dither signal generating circuit for producing a periodical dither signal having a constant wave pattern, a shift control circuit for shifting the level of the center of the dither signal, a driving circuit for producing a driving output according to the dither signal, and an $O_2$ sensor for detecting the concentration of oxygen in exhaust gases passing through the exhaust passage. The system is provided with a device for detecting a transient state of the engine operation, and a control circuit including an integrating circuit connected to the $O_2$ sensor and a square wave generating circuit for generating square pulses according to the integration output of the integrating circuit for driving the electromagnetic valve. A switching circuit is provided for connecting the $O_2$ sensor to the control circuit and disconnecting the shift control circuit from the $O_2$ sensor in dependency on the output signal of the device for detecting the transient state. Thus, in the transient state, the air-fuel ratio is controlled by the integration output signal of the control circuit, whereby the air-fuel ratio may be quickly controlled to the stoichiometric air-fuel ratio.

8 Claims, 11 Drawing Figures

AIR-FUEL RATIO CONTROL SYSTEM

BACKGROUND OF THE INVENTION

The present invention relates to a system for controlling an air-fuel ratio for an internal combustion engine emission control system having a three-way catalyst, and more particularly to a system for controlling the air-fuel ratio to a value approximating the stoichiometric air-fuel ratio so as to effectively operate the three-way catalyst.

Such a system is a feedback control system, in which an oxygen sensor is provided to sense an oxygen content of exhaust gases to generate an electrical signal as an indication of the air-fuel ratio of an air-fuel mixture supplied by a carburetor. The control system comprises a comparator for comparing the output signal of the oxygen sensor with a predetermined value, a proportional and integrating circuit connected to the comparator, a driving circuit for producing square wave pulses from the output signal of the proportional and integrating circuit, and an on-off type electromagnetic valve for correcting the air-fuel ratio of the mixture. The control system operates to determine whether the feedback signal from the oxygen sensor is higher or lower than a predetermined reference value corresponding to the stoichiometric air-fuel ratio for producing a compensatory signal for actuating the on-off electromagnetic valve to thereby control the air-fuel ratio of the mixture.

The response of such a feedback control system is inherently slow because a detecting time by the oxygen sensor is delayed. More particularly, the mixture corrected by the on-off type electromagnetic valve is induced in the cylinder of the engine passing through the induction passage and burned therein, and thereafter discharged to the exhaust passage. Therefore, the time when the oxygen sensor detects the oxygen content of the exhaust gases based on the corrected mixture, a compensatory action with the on-off electromagnetic valve has overshot the desired point. As a result, a rich or lean mixture caused by the overshooting is induced in the engine and the deviation is detected by the oxygen sensor. Thus, the compensatory action in the opposite direction will be initiated. After such oscillation of the control operation, the variation of the air-fuel ratio of the mixture will converge toward the stoichiometric ratio. Therefore, the deviation of the air-fuel ratio of the mixture is corrected to the stoichiometric ratio with some delay.

If the control gain of the proportional and integrating circuit is decreased, the overshooting may be reduced in the steady state of the engine operation. However, the control is not sufficiently effected in the transient state such as acceleration or deceleration.

FIGS. 3A to 3C show output waveforms of the proportional and integrating circuit each of which is shifted by "S" in the transient state, and FIGS. 4A to 4C show output waveforms of the oxygen sensor corresponding to FIGS. 3A to 3C. FIG. 3A shows the waveform of the conventional control system and FIG. 3B shows the waveform of a system in which the control gain of the proportional and integrating circuit is reduced. The response time $T_B$ of FIG. 3B is longer than the response time $T_A$ of FIG. 3A. In the system of FIG. 3C, only the control gain of the integrating circuit is increased. The response time $T_C$ is smaller than the response time $T_A$.

If the control gain of the circuit is reduced, the response time increases as shown in FIG. 3B. Therefore, the control will be delayed. On the other hand, if the control gain of the circuit is increased, the response time may be reduced as shown in FIG. 3C. However, the control operation is liable to overshoot.

On the other hand, Japanese Patent Application No. 54-98853 (U.S. patent application Ser. No. 174,385) (not prior art) discloses a system intended for improvement of such control delay of the conventional system, in which the oscillation center of a dither wave signal detected by the oxygen sensor is shifted according to the deviation of the output signal of the oxygen sensor for correcting the air-fuel ratio. However, when the engine is rapidly accelerated or decelerated, the correcting operation is delayed even in such a system.

SUMMARY OF THE INVENTION

An object of the present invention is to provide a control system which operates by a dither signal in a steady state of the engine operation and operates by a proportional and integration output control having a large control gain of the circuit in a transient state of the engine operation.

According to the present invention, there is provided an air-fuel ratio control system for an internal combustion engine having an intake passage, an exhaust passage, air-fuel mixture supply means, on-off type electromagnetic valves for correcting an air-fuel ratio of an air-fuel mixture supplied by said air-fuel mixture supply means, dither signal generating circuit means for producing a periodical dither signal having a pattern, a shift control circuit means for shifting the level of the center of said dither signal, driving circuit means for producing a driving output for said on-off type electromagnetic valve via the shifted dither signal, and an $O_2$ sensor for detecting the concentration of oxygen in the exhaust gases passing through said exhaust passage, the system further comprising, means for detecting the transient state of the engine operation by the waveform of the dither signal detected by said $O_2$ sensor, a control circuit including an integrating circuit operatively connected to said $O_2$ sensor and a square wave generating circuit for generating square pulses according to the integration output of the integrating circuit for driving said electromagnetic valve, and switching means for closing the circuit from said $O_2$ sensor to said driving circuit through said control circuit and cutting off the circuit from said $O_2$ sensor to said driving circuit through said shift control circuit by the output signal of said means for detecting the transient state.

Other object and feature of the present invention will be apparent from the following description with reference to the accompanying drawings.

DETAILED DESCRIPTION OF THE PREFERRED EMBODIMENTS

Figure 1:
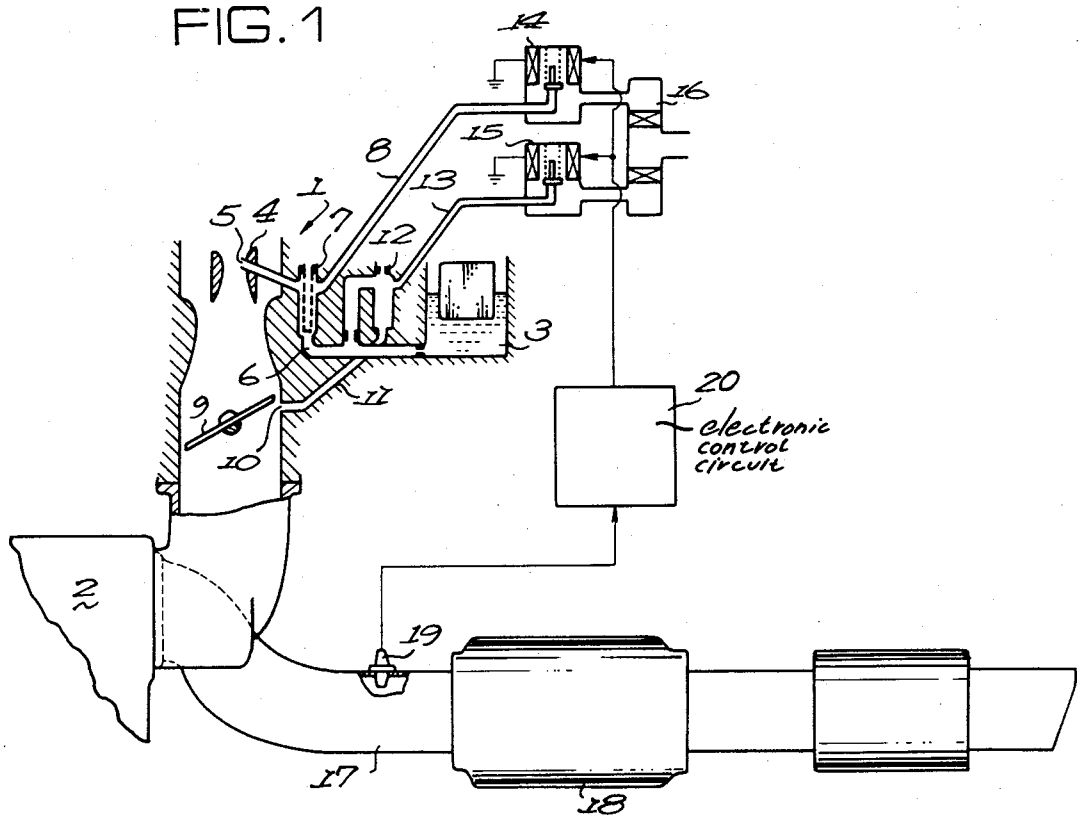
FIG. 1 is a schematic view of the system according to the present invention.

Referring to FIG. 1, a carburetor 1 communicates with an internal combustion engine 2. The carburetor 1 comprises a float chamber 3, a venturi 4 formed in an intake passage, a nozzle 5 communicating with the float chamber 3 through a main fuel passage 6, and a slow port 10 provided near a throttle valve 9 in the intake passage communicating with the float chamber 3 through a slow fuel passage 11. Air correcting passages 8 and 13 are disposed in parallel to a main air bleed 7 and a slow air bleed 12, respectively. On-off electromagnetic valves 14 and 15 are provided for the air correcting passages 8 and 13, respectively. Inlet ports of each on-off electromagnetic valves 14 and 15 respectively communicate with the atmosphere through an air filter or air cleaner 16. An $O_2$ sensor 19 is disposed in an exhaust pipe 17 which communicates with the internal combustion engine 2. The $O_2$ sensor 19 detects the oxygen content of the exhaust gases. A three-way catalytic converter 18 is provided in the exhaust pipe 17 downstream of the $O_2$ sensor 19. The output signal of the $O_2$ sensor 19 is applied to an electronic control circuit 20 of an electronic control system. The electronic control circuit 20 operates to correct the air-fuel ratio of the air-fuel mixture provided by the carburetor 1.

Figure 2:
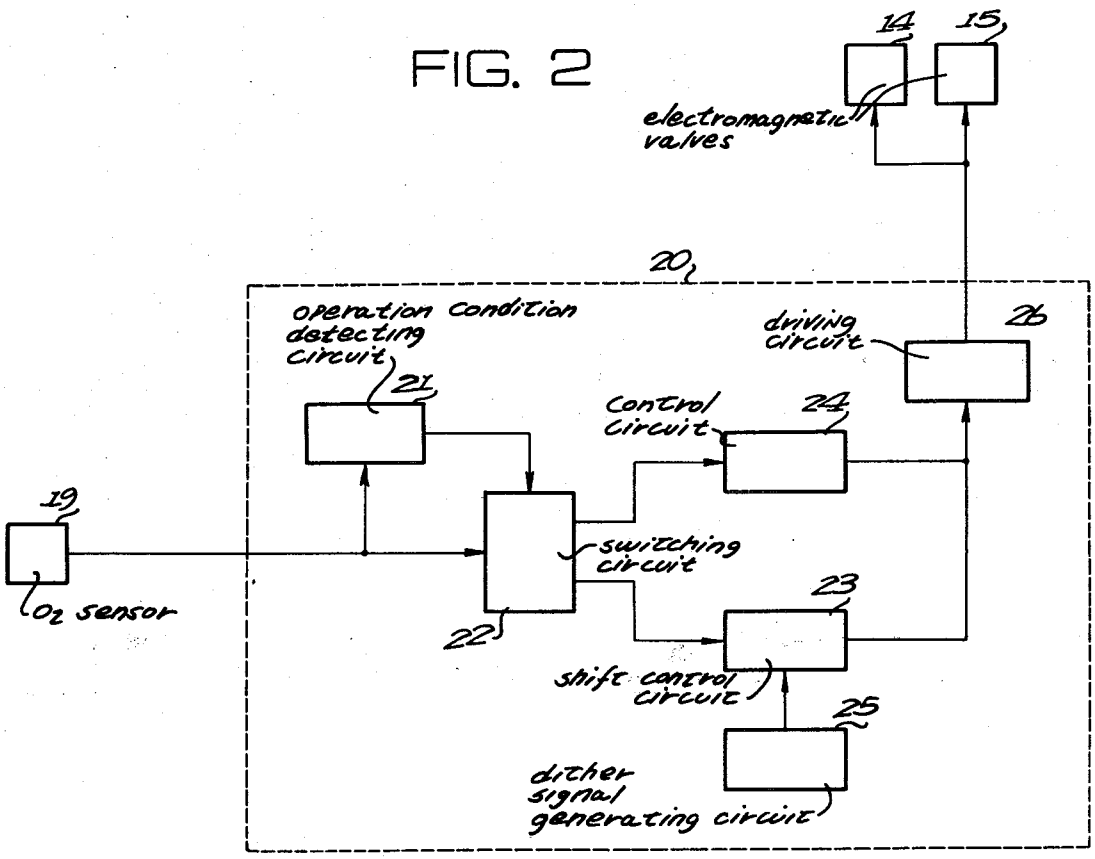
FIG. 2 is a block diagram of an electronic control circuit of the system.

FIG. 2 shows the block diagram of the electronic control circuit 20.

The output of the oxygen sensor 19 is connected to an operation condition detecting circuit 21, and to a switching circuit 22.

The control circuit 24 comprises a proportional and integrating circuit having a large control gain and a square wave pulse generating circuit connected to the proportional and integrating circuit. The control circuit 24 is so arranged that the pulse width of the produced square wave pulse changes in dependency on the output of the proportional and integrating circuit.

The output of a dither signal generating circuit 25 is connected to a shift control circuit 23. The circuit 25 is provided for generating a pulse train comprising a constant dither wave pattern. Outputs of the control circuit 24 and the shift control circuit 23 are connected to electromagnetic valves 14 and 15 through a driving circuit 26. The duty ratio of the driving pulse from the driving circuit 26 varies in dependency on the level of the output signal of the control circuit 24 or via the shift control circuit 23 on the level of the dither signal fed from the circuit 25 for correcting the air-fuel ratio of the mixture to be supplied to the engine to the stoichiometric value.

Figures 4A, 4B, 4C, 4D:
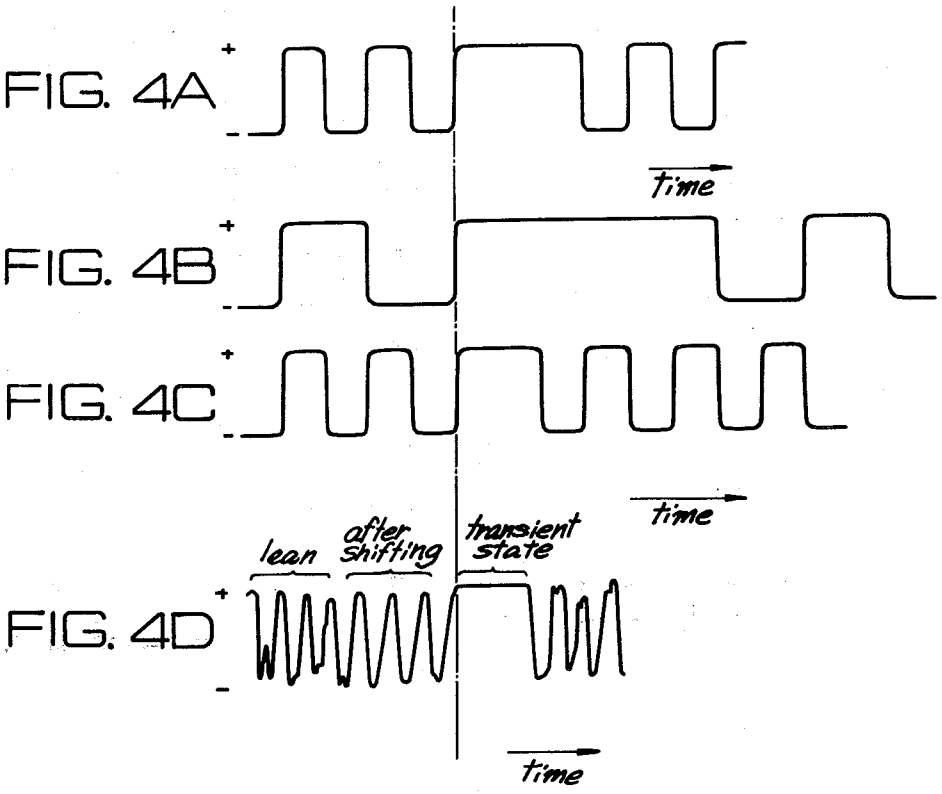
FIGS. 4A to 4D show output waveforms detected by the $O_2$ sensor.

Referring to FIG. 4D, the output of the $O_2$ sensor periodically oscillates in the steady state of the engine operation, when electromagnetic valves 14 and 15 are operated by the dither signal. However, in the transient state, the output does not oscillate as illustrated. The detecting circuit 21 senses the output waveform of the $O_2$ sensor 19 upon the transient state, which has a long width as shown in FIG. 4D, thereby distinguishing the transient state from the steady state. For example, the detection may be performed by detecting the width of the output waveform. The output signal of the detecting circuit 21 causes the switching circuit 22 to change the connection between the $O_2$ sensor 19 and respective of the circuits 24 and 23. In the steady state, the $O_2$ sensor 19 is connected to the shift control circuit 23 and, in the transient state the $O_2$ sensor 19 is connected to the control circuit 24 through the switching circuit 22, respectively.

In the steady state, the output of the $O_2$ sensor is operatively sent to the shift control circuit 23. When the concentration of oxygen in the exhaust gases deviates from a predetermined value corresponding to the stoichiometric air-fuel ratio, the waveform of the output of the $O_2$ sensor is deformed. FIG. 4D shows the output waveform, the left end deformed wave of which means that the output of the $O_2$ sensor deviates to the lean side. The shift control circuit 23 detects such deformation of the output waveform thereby detecting the deviation and shifts the level of the dither signal fed from the circuit 25 in dependency on the deviation of the detected signal. The shifted dither signal is fed to the electromagnetic valves 14 and 15 through the driving circuit 26, so that the air-fuel ratio of the mixture may be controlled to the stoichiometric air-fuel ratio.

Figures 3A, 3B, 3C, 3D:
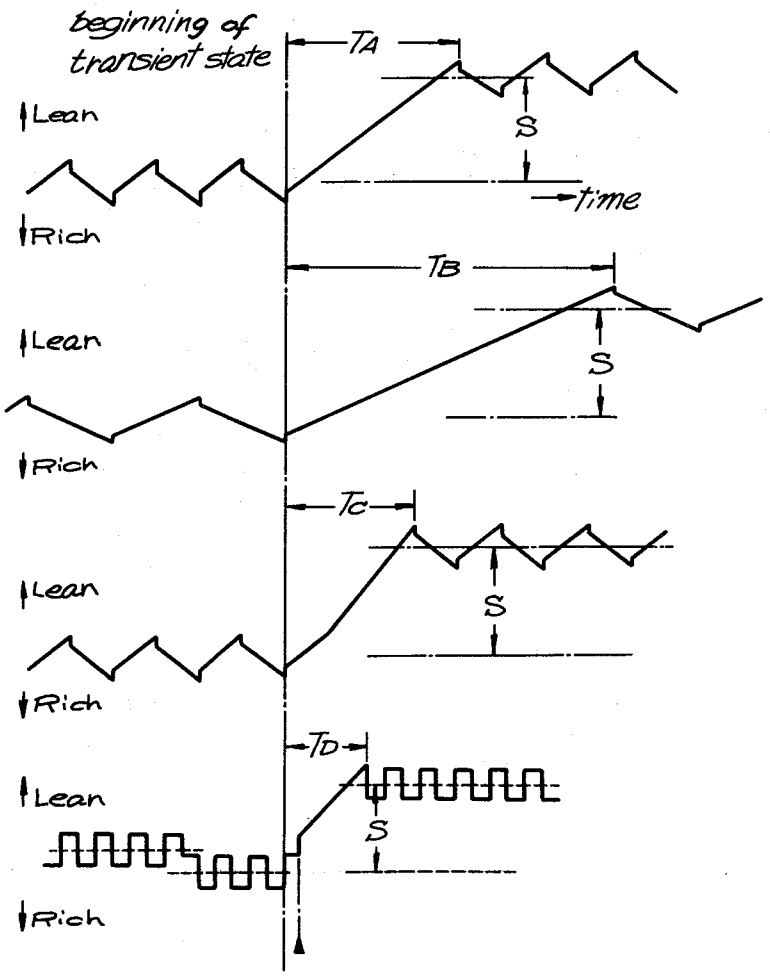
FIGS. 3A to 3D show output waveforms of a proportional and integrating circuit in electronic control circuits.

When the transient state is detected by the detecting circuit 21, the output signal of the $O_2$ sensor 19 is fed to the control circuit 24 through the switching circuit 22. The control circuit 24 having a large control gain produces an integration control signal dependent on the output signal of the $O_2$ sensor so that a great deviation of the output signal in the transient state may be quickly corrected. The integration control signal is shown in FIG. 3D by the wave during the time $T_D$. The integration control signal is changed to square wave pulses which are fed to the valves 14 and 15 through the driving circuit 26. Thus, the deviation of the air-fuel ratio may be more quickly corrected to the stoichiometric air-fuel ratio than the controls shown in FIGS. 3A, 3B and 3C.

Although FIGS. 3A to 3D and FIGS. 4A to 4D show the control from the lean air-fuel ratio to the stoichiometric air-fuel ratio, the control from the rich side may be similarly performed.

Figure 5:
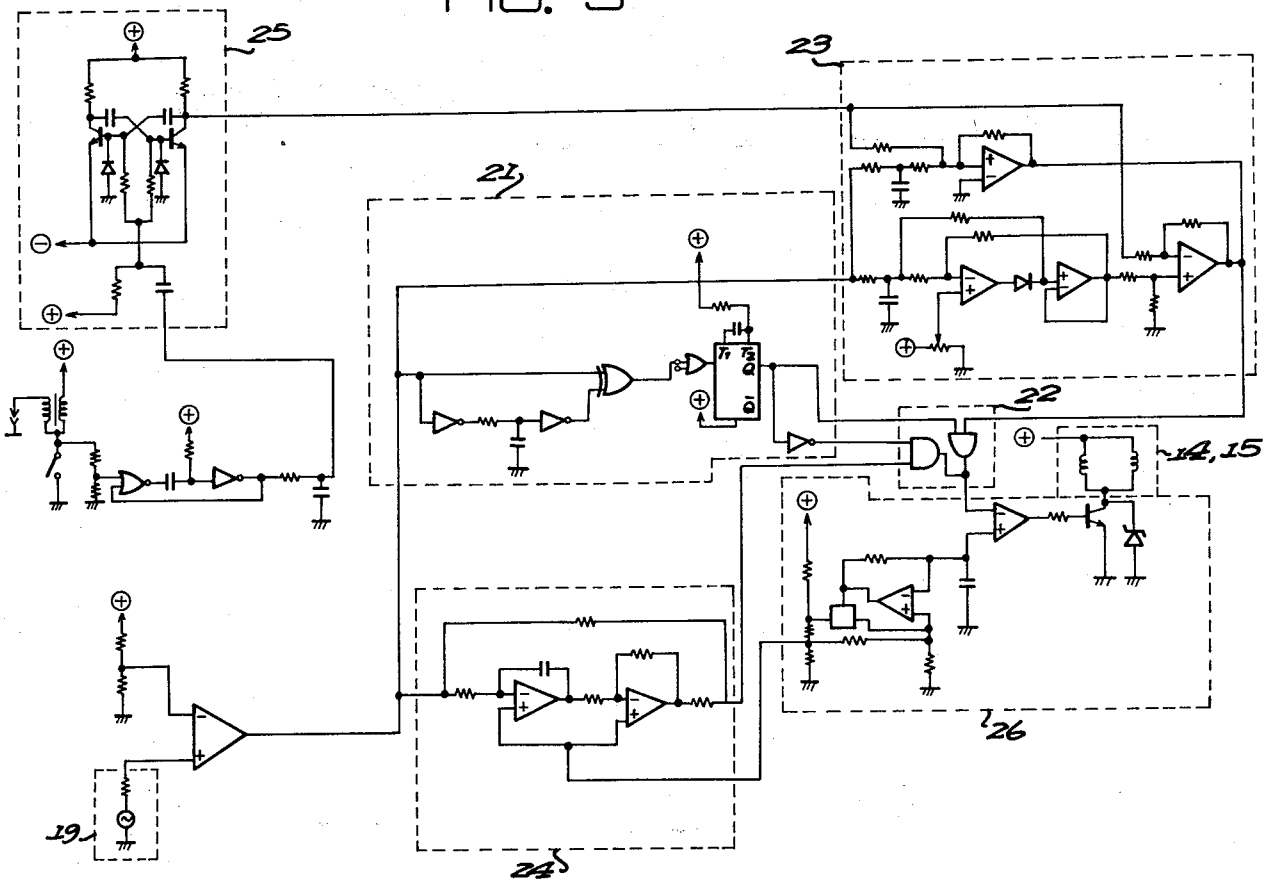
FIG. 5 shows an example of the electronic control circuit.

FIG. 5 shows an example of the electronic control circuit, in which the same parts as FIG. 2 are identified by the same numeral. The switching circuit 22 is located between the circuits 23 and 24 and driving circuit 26 unlike the circuit of FIG. 2.

From the foregoing, it will be understood that the present invention provides a control system which controls the air-fuel ratio by the dither signal in the steady state and by the integration control signal in the transient state, whereby the air-fuel ratio may be rapidly controlled to the stoichiometric air-fuel ratio.

What is claimed is:

1. In an air-fuel ratio control system for an internal combustion engine of the type having an intake passage, an exhaust passage, an air-fuel mixture supply device, an on-off type electromagnetic valve means for correcting the air-fuel ratio of the air-fuel mixture supplied by said air-fuel mixture supply device, $O_2$ sensor means for detecting the concentration of oxygen in exhaust gases passing through said exhaust passage, the improvement comprising a dither signal generating circuit means for producing a periodical dither signal having an unchanging wave form pattern, a shift control circuit means for shifting the level of a center of said dither signal in dependency on the concentration of oxygen detected by the $O_2$ sensor means, driving circuit means operatively connected to said shift control circuit means and for producing a driving output for said on-off type electromagnetic valve means, means for detecting a transient state of the engine operation by a variation in a waveform corresponding to the dither signal, said $O_2$ sensor means for generating said waveform by detecting said concentration of oxygen in the exhaust gases passing through said exhaust passage, a control circuit including an integrating circuit and a square wave generating circuit means for generating square pulses according to the integration output of the integrating circuit for operatively driving said electromagnetic valve means, and switching means for operatively connecting said $O_2$ sensor means to said driving circuit means via said control circuit and for disconnecting said $O_2$ sensor means from said driving circuit means via said shift control circuit means when said means for detecting detects the transient state.

2. The air-fuel ratio control system according to claim 1, wherein said switching means is connected between said $O_2$ sensor means and inputs of said control circuit and said shift control circuit means, respectively.

3. The air-fuel ratio control system according to claim 1, wherein said switching means is connected between outputs of said detecting means, said control circuit and said shift control circuit means and an input of said driving circuit means.

4. The air-fuel ratio control system according to claim 1, further comprising:

a comparator means is connected to an output of said $O_2$ sensor means and to inputs of said detecting means and operatively to inputs of said control circuit and said shift control circuit means, respectively.

5. The air-fuel ratio control system according to claim 1, wherein said $O_2$ sensor means is for providing an output wave form of the concentration of oxygen in the exhaust gases detected by said $O_2$ sensor means corresponding to said dither signal but having substantially changed pulse width during the transient state.

6. The air-fuel ratio control system according to claim 1, wherein said switching means is connected between said $O_2$ sensor means and inputs of said control circuit and said shift control circuit means, respectively.

7. The air-fuel ratio control system according to claim 1, wherein said switching means is connected between outputs of said detecting means, said control circuit and said shift control circuit means and an input of said driving circuit means.

8. The air-fuel ratio control system according to claim 7, wherein said switching means comprises two AND gates each having two inputs, one of said inputs of one of said AND gates is connected to the output of said shift control circuit means and one of said inputs of the other of said AND gates is connected to the output of said control circuit, the others of said inputs of said AND gates are connected to the outputs of said detecting means, said outputs of said detecting means being inverted with respect to each other, and the outputs of said AND gates are connected to the input of said driving circuit means.

* * * * *